US009845662B2

(12) United States Patent
Jepp et al.

(10) Patent No.: US 9,845,662 B2
(45) Date of Patent: Dec. 19, 2017

(54) DOWNHOLE ACTUATOR

(71) Applicant: CFF Technologies Limited, Aberdeen (GB)

(72) Inventors: Bruce Thornton Jepp, Westhill (GB); Keith Scott Gaskin, Aberdeen (GB); Rae Andrew Younger, Ellon (GB); Stuart Thomas Rothnie, Inverurie (GB)

(73) Assignee: CFF Technologies Limited, Aberdeen (GB)

( * ) Notice: Subject to any disclaimer, the term of this patent is extended or adjusted under 35 U.S.C. 154(b) by 527 days.

(21) Appl. No.: 14/389,928

(22) PCT Filed: Mar. 28, 2013

(86) PCT No.: PCT/GB2013/050844

§ 371 (c)(1),
(2) Date: Oct. 1, 2014

(87) PCT Pub. No.: WO2013/150280

PCT Pub. Date: Oct. 10, 2013

(65) Prior Publication Data

US 2015/0068763 A1 Mar. 12, 2015

(30) Foreign Application Priority Data

Apr. 3, 2012 (GB) ..... 1205954.9

(51) Int. Cl.
*E21B 41/00* (2006.01)
*E21B 34/14* (2006.01)
(Continued)

(52) U.S. Cl.
CPC ..... *E21B 34/14* (2013.01); *E21B 21/103* (2013.01); *E21B 41/00* (2013.01); *E21B 2034/005* (2013.01)

(58) Field of Classification Search
CPC ..... E21B 34/14; E21B 21/103; E21B 41/00; E21B 2034/005
See application file for complete search history.

(56) References Cited

U.S. PATENT DOCUMENTS 2,879,032 A * 3/1959 Whittle ..... E21B 4/02 173/177
2,963,099 A * 12/1960 Gianelloni, Jr. ..... E21B 4/02 175/107

(Continued)

FOREIGN PATENT DOCUMENTS

GB 2183272 A 6/1987
WO WO-2011/018659 A1 2/2011

OTHER PUBLICATIONS

Strømmen, Henrik, "International Search Report" prepared for PCT/GB2013/050844, dated Feb. 17, 2014, 3 pages.

*Primary Examiner* — Kenneth L Thompson
*Assistant Examiner* — Steven MacDonald
(74) *Attorney, Agent, or Firm* — Winstead PC

(57) ABSTRACT

A downhole actuator typically for a downhole tool such as a valve, and typically for incorporation in a string of tubulars in an oil or gas well has a central axis with radially movable counterweights on opposite sides of the axis, which move radially outward to change the activation state of the actuator. The counterweights are supported by link arms which control the movement of the counterweights in response to centrifugal force created by rotation of the body, for example, during rotary drilling operations of the string. Radial outward movement of the counterweights typically transmits axial forces between sleeves at the upper and lower ends of the counterweights, so when the counterweights move radially outward, the upper and lower sleeves approach one another, which typically triggers the actuator.

21 Claims, 9 Drawing Sheets

(51) Int. Cl.
*E21B 21/10* (2006.01)
*E21B 34/00* (2006.01)

(56) References Cited

U.S. PATENT DOCUMENTS

| | | | | | |
|---|---|---|---|---|---|
| 3,767,332 | A | * | 10/1973 | Wickham | B24B 55/00 137/57 |
| 3,802,515 | A | * | 4/1974 | Flamand | E21B 4/02 173/176 |
| 3,967,680 | A | | 7/1976 | Jeter | |
| 4,265,604 | A | * | 5/1981 | Dreher | F01B 25/16 137/57 |
| 4,467,526 | A | * | 8/1984 | Otte | E21B 47/02232 33/304 |
| 4,790,381 | A | | 12/1988 | Armell | |
| 2003/0029308 | A1 | | 2/2003 | Van Drentham-Susman et al. | |
| 2005/0211471 | A1 | * | 9/2005 | Zupanick | E21B 21/103 175/57 |
| 2011/0266001 | A1 | * | 11/2011 | Dykstra | E21B 43/12 166/319 |

* cited by examiner

DOWNHOLE ACTUATOR

This invention relates to a downhole actuator, and to a method of its use for controlling a downhole device, for example, a valve. In certain aspects, the invention is used to control a circulation sub, although other valves and other kinds of downhole devices apart from valves may be suitable for use with aspects of the invention.

Downhole actuators are well known for use in controlling downhole devices. Our earlier PCT application WO2011/018659 discloses a previous design of actuator for a valve, in which a fluid passageway is opened and closed by the action of a centrifugal force on a retaining member typically in the form of a ball. The present invention represents an improvement over our earlier design, with improved consistency of performance in deviated wellbores.

According to the present invention, there is provided a downhole device having a body with an axis, a bore for passage of fluid through the body, a closure device for restricting passage of fluid through the bore, and an actuator for actuating the closure device; the actuator comprising first and second counterweight devices moveably mounted at different circumferential positions around the axis of the downhole device, wherein the counterweight devices are radially movable relative to the body between first and second positions, wherein movement of the counterweight devices between the first and second positions actuates the closure device between different activation states.

Typically the device comprises a valve, and typically has an inlet and a primary outlet, and optionally a secondary outlet. Typically actuation of the device diverts fluid normally flowing from the inlet to the primary outlet into an alternate fluid pathway, in which the fluid flows from the inlet to the alternate outlet. Typically, the closure device is capable of closing the bore and preventing or substantially preventing the flow of fluid past the closure device and through the bore. Typically, the closure device diverts fluid flowing through the bore to the flow path leading to the alternate outlet. In one aspect, the downhole device is embodied in a circulation sub, and the closure device diverts fluid normally flowing past the closure device within the bore into a circulation pathway, which typically passes through the body of the device.

In certain aspects, the closure device can be adapted to restrict the passage of fluid through the bore, but to allow a reduced flow through the bore without closing the bore entirely. Optionally, the closure device has a port allowing passage of some fluid through the closure device when the closure device is in the closed position, while the remainder of the fluid is diverted by the closure device into the alternate pathway (e.g. the circulation port).

The invention also provides a method of actuating a downhole device, the downhole device having an axis, and having first and second counterweight devices connected on either side of the axis, the method comprising rotating the device around the axis, causing radial movement of the counterweight devices away from the axis, whereby movement of the counterweight devices causes a change in the activation state of the device, typically causing a change in the activation state of a closure device restricting a through bore through a string for the passage of fluid through the string.

The invention also provides an actuator, typically for a downhole tool, and typically for incorporation in a string of tubulars in an oil or gas well, the actuator having a central axis, and having first and second counterweight devices movably connected within the actuator and spaced apart on opposite sides of the axis, the counterweight devices being movable between first and second positions wherein the movement of the counterweight devices between the first and second positions causes a change in the activation state of the actuator.

Optionally, the counterweight devices are supported by a linkage mechanism that guides the movement of the counterweight devices between the first and second positions. The linkage mechanism can optionally comprise at least one link arm for each counterweight device. Typically, each counterweight device is supported by a number of link arms, and typically the movement of the counterweight device between the first and second positions is controlled by the link arms, typically so that the counterweight device moves radially relative to the body of the device when moving between the first and second positions.

Typically, the counterweight devices are moved between the first and second positions by centrifugal force created by rotation of the body. Optionally, the body is incorporated in a string, such as a drillstring, and the rotation of the body is typically caused by rotation of the string as a whole, typically from the surface, and typically during rotary drilling operations.

The counterweights are typically circumferentially spaced around the body, and typically the centrifugal force is balanced around the circumference. This is typically achieved by spacing the counterweights at equal distances around the circumference of the body, but in certain circumstances the spacing between adjacent counterweights can be different. Optionally the arrangement of counterweight devices around the body can be symmetrical around the axis of the body. In some cases, the circumferential arrangement of counterweights around the body can be non-symmetrical. Even or odd numbers of counterweights can be provided, typically spaced equi-distantly around the circumference of the body.

The masses of the counterweights can be the same, or in some aspects can be different between each respective counterweight, but in each arrangement, it is typically the case that the centrifugal force applied by any particular counterweight is balanced by at least one or more other counterweight, so that the centrifugal force is balanced around the circumference of the body and is not eccentric.

Typically, the movement of the counterweight devices between the first and second radial positions results in radial outward movement of the counterweight devices from a first radially retracted position in which the counterweight devices are retracted close to the axis of rotation of the body (typically the axis of the body is co-axial with the axis of rotation of the body) to a second radially extended position in which the counterweight devices have moved radially outwards (typically in opposite directions) away from the axis of rotation of the body. In the first position, the counterweight devices are typically aligned with the axis of rotation of the body, and in the second position, the counterweight devices are typically also aligned with the axis of rotation of the body, but radially spaced further from the axis than in the first position. The orientation of the counterweight devices is typically maintained by the link arms as the counterweight devices move between the first and second positions.

The counterweight devices are typically connected at axially spaced apart locations (for example at or near their upper and lower ends) to upper and lower sleeves. Typically the sleeves interconnect the counterweight devices. Typically the counterweight devices are spaced on different sides of the axis of rotation of the body, and are typically spaced at 180 degrees with respect to one another around that axis.

Typically, the upper and lower sleeves surround the bore and generally can have circular cross-sections, and typically the counterweight devices are circumferentially spaced equi-distantly in relation to one another around the sleeves. The sleeves are typically connected to the counterweight devices by pivot links pivotally connected at the sleeves and at the upper and lower ends of the counterweight devices. The pivot links are typically provided by the link arms, which typically restrict and control the extent and path of radial movement of the counterweight devices between the first and second positions.

The link arms typically serve to transmit axial forces between the upper and lower sleeves at the axially spaced positions (e.g. upper and lower ends) of the counterweight devices, controlling and optionally urging relative axial movement between the upper and lower sleeves when the counterweight devices move radially. For example, when the counterweight devices move from the first radially retracted position, to the second radially extended position, the upper and lower sleeve devices move axially closer to one another. The axial movement of the sleeves as a result of the radial movement of the counterweight devices typically triggers the actuator, typically resulting in activation of the closure device, typically by changing the configuration of a linkage mechanism operatively connected between one of the sleeves and the closure device.

The upper and lower sleeves typically surround a central axial tubular member forming the bore of the device. Typically, the sleeve devices slide axially along the outer surface of the tubular. Typically, the closure device closes the tubular member, and is typically mounted on the upper end of the tubular member to close the inlet of the tubular member at the upper end thereof.

Typically, the closure member can be locked in its open or in its closed configuration. Typically the locking is effected by a locking piston, typically located adjacent the closure device, typically at the upper end of the bore. Typically, the locking piston is in the form of a piston sleeve adapted to move relative to the tubular member, which typically constitutes the bore between an unlocked position and a locked position, in which the locking piston restricts the actuation of the closure device, typically by physically engaging it and preventing or restricting its movement to close or restrict the bore. Typically, the locking piston moves between the unlocked and locked positions as a result of fluid pressure acting on the locking piston to move it relative to the tubular.

Typically, the locking piston is biased by resilient device such as a spring into the unlocked configuration. Typically, the locking piston occludes the alternate pathway in its unlocked configuration.

Typically, the device has a balancing mechanism adapted to balance the volume of hydraulic fluid within the body of the device between the first and second positions of the counterweight devices. The balancing mechanism typically comprises a piston sealed within an annulus between the bore and the body in fluid communication with the radial chamber adjacent to the counterweight devices, whereby changes in the volume of the radial space adjacent to the counterweight devices as a result of the movement of the counterweight devices between the first and second positions can be accommodated by the balancing mechanism, optionally by sliding movement of the piston within the annulus. While an annular piston is a useful configuration for the balancing mechanism, a piston housed within a bore is suitable for certain examples of the invention. Typically the balancing piston is typically connected to the upper sleeve, and typically moves linearly with the upper sleeve.

Examples of the invention can optionally be utilised to activate other devices apart from valves, and to change the activation state of various devices, typically by physical connection between the counterweight devices, typically in the form of the control rods etc and link arms, but in certain other examples, change of the activation status can be transmitted by non-physical mechanisms, for example electronic transmission without requiring a physical connection between the counterweight devices and the element being actuated. Typically the element being actuated can be a closure device, but could also be a signal device initiating a signal to a different part of the string or to another tool within the string in order to signal or power the transition of that tool from one configuration to another. In one aspect of the invention, the actuator changes its activation state by rotation of the string and as a result activates a different tool in the string, for example, a latching or hanger device, or a cutting tool such as a reamer etc. Typically the other tool activated by the actuator is below the actuator in the string, and the axial translation of the sleeve in the actuator pushes or pulls a component in the actuated device between different configurations corresponding to different states of activation of the actuated device. For example, the actuator can push or pull cutters on a reamer device below the actuator up and down ramps or around pivot points, in order to change their activation status.

Typically the body has a fluid flowpath, and permits passage of fluid through the body in at least one of the configurations. Typically changes in activation status results in changes in fluid flow through the body, for example, re-routing of the fluid through the body from a first flowpath to a second flowpath. One typical example of this is diversion of the fluid through a port, typically in the side wall of the body, but other in aspects the activation status of the body changes without resulting in re-routing of fluids through the body. Optionally changes in activation status results in choking or reduction of fluid flow through the flowpath. Typically changes in the activation status are maintained by fluid pressure acting on the closure member.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one aspect or example can typically be combined alone or together with other features in different aspects or examples of the invention.

Various examples and aspects of the invention will now be described in detail with reference to the accompanying figures. Still other aspects, features, and advantages of the present invention are readily apparent from the entire description thereof, including the figures, which illustrates a number of exemplary aspects and implementations. The invention is also capable of other and different examples and aspects, and its several details can be modified in various respects, all without departing from the spirit and scope of the present invention. Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having" "containing" or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or is preceding the recitation of the composition, element or group of elements and vice versa.

All numerical values in this disclosure are understood as being modified by "about". All singular forms of elements, or any other components described herein are understood to include plural forms thereof and vice versa. References to positional descriptions such as "upper" and "lower" and directions such as "up", "down" etc in relation to the well are to be interpreted by a skilled reader in the context of the examples described and are not to be interpreted as limiting the invention to the literal interpretation of the term, but instead should be as understood by the skilled addressee, particularly noting that "up" with reference to a well refers to a direction towards the surface, and "down" refers to a direction deeper into the well, and includes the typical situation where a rig is above a wellhead, and the well extends down from the wellhead into the formation, but also horizontal wells where the formation may not necessarily be below the wellhead.

In the accompanying drawings.

Figure 1:
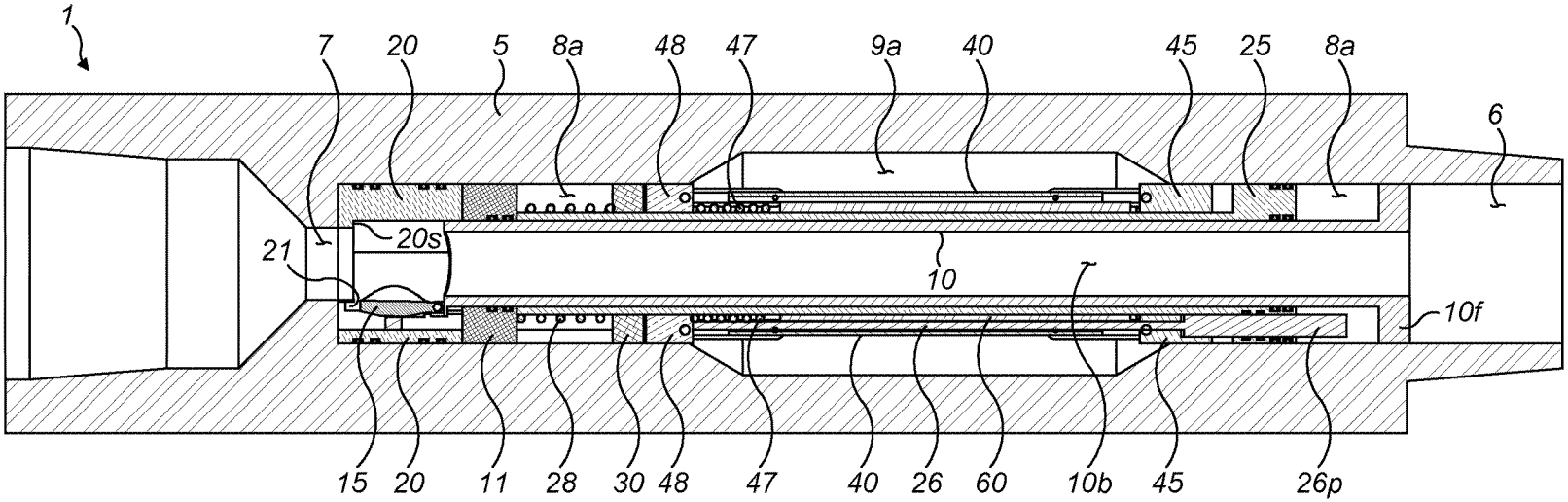
FIG. 1 shows a side sectional view (through the line A-A in FIG. 5) of a downhole device embodying the invention, being run into a hole in an open configuration.

Referring now to FIG. 1, a downhole device is typically in the form of a circulation sub 1 incorporating a valve with a body 5 in the form of a tubular having a central axis and having an axial bore 6 and box and pin connections at either end of the bore enabling the body 5 to be incorporated within a string of tubulars for deployment in an oil or gas well as is known in the art. The bore 6 has a central portion 8, a throat 7 located above the central portion 8, and an expansion chamber 9 located within the central portion 8.

The bore 6 typically houses a tubular member in the form of a tubular 10 extending co-axially with the bore 6, and typically having a narrower diameter than the central portion 8 of the bore, and a flange 10*f* spacing the tubular 10 from the inner surface of the central portion of the bore 8, thereby forming an annulus 8*a* between the inner surface of the central portion of the bore 8 and the outer surface of the tubular 10 and a similar annulus 9*a* between the tubular 10 and the expansion chamber 9. The tubular 10 typically provides an inner bore 10*b* passing substantially from the throat 7 at the upper end to the lower end of the valve body 5. The inner diameter of the bore 10*b* of the tubular 10 can be relatively wide, allowing a large bore conduit between the upper and lower ends of the valve 1, and allowing high volumes of fluid to pass at high speed through the valve when the valve is open. The large diameter central bore 10*b* of the tubular 10 typically enables normal wireline and coil tubing operations through the centre of the circulation device, without occlusion of the bore 10*b*. Typically the flange 10*f* is secured to the inner surface of the bore 6 in the body 5, restricting axial movement of the tubular 10 in the body 5, typically by shear pins, or by a ledge, or by other securing mechanism. Typically the expansion chamber 9 can be sealed to prevent debris entering, and can therefore have a sealed volume of clean hydraulic fluid enabling reduced service requirements.

The upper end of the tubular 10 is provided with a closure device typically in the form of a flapper 15, although other forms of closure device can be used with alternate examples of the invention. In this example, the flapper 15 is pivotally mounted to an upper edge of the side wall of the tubular 10, and can pivotally move around the mounting from the open position shown in FIG. 1, where the flapper 15 does not occlude the bore 10*b* of the tubular 10, to the closed position shown in FIG. 3, where the flapper 15 has pivoted into a closed position, in which it occludes the bore 10*b* of the tubular 10.

Above the upper end of the tubular 10 the valve 1 is provided with a control piston 20 which is typically in the form of a sleeve that is sealed within the central portion of the bore 8 and is axially slidable therein, relative to the tubular 10. The upper end of the control piston 20 has an inlet to admit fluid which is typically no smaller than the throat 7, so that fluid can pass substantially unhindered from the throat 7 and through the control piston 20. Adjacent to the opening of the upper end of the control piston 20, the lower surface of the control piston typically has a recess 21 adapted to receive a portion of the flapper 15 in order to lock it in position. The control piston 20 is typically adapted to slide within the bore between the position in FIG. 1, where the flapper 15 is clear of the recess 21 and is unobstructed by the piston 20, to the position shown in FIG. 2, where the piston 20 has moved axially down the central portion of the bore 8, to engage the flapper 15 within the recess 21 and restrict its movement around its pivotal mounting, preventing it from closing the bore 10*b* of the tubular 10.

The tubular 10 is typically centralised within the bore 6 of the body 5 by the flange 10*f* at the lower end and by a sliding spacer ring 11 at the upper end. Typically, the sliding spacer ring 11 is sealed against the outer surface of the tubular 10, and is typically secured to the upper end of a balancing piston 25, which is typically in the form of a sleeve sealed between the outer surface of the tubular 10 and the inner surface of the body 6. The lower end of the balancing piston 25 has flange that is sealed within the central portion of the bore 8 across the annulus 8*a*. The upper end of the balancing piston 25 is typically secured, for example by screwing or fixing such as bolts, to the sliding spacer ring 11, so that the sliding spacer ring 11 and balancing piston 25 move as a unitary component. The sliding spacer ring 11 and balancing piston 25 are subjected to a biasing force by a resilient device typically in the form of a control piston spring 28, which is held in compression between the sliding spacer ring 11 and a fixed block 30 which is secured to the inner surface of the central portion of the bore 8. The control piston spring 28 is typically held in compression, and urges the sliding spacer ring 11 and balancing piston 25 axially upwards, to push the control piston 20 up the bore 6 towards the throat 7 at the upper end of the body 5.

The valve 1 has an actuator in the form of a counterweight assembly V to control the state of activation of the flapper 15. The counterweight assembly V comprises first and second counterweight devices as will now be described.

In this example, the counterweight devices comprise four plates 40, arranged in opposed pairs at equi-distant spacings around the circumference of the tubular 10.

The plates 40 typically all have the same mass and dimensions, and their equi-distant spacing in relation to the axis of the valve and in relation to one another around the circumference of the valve body 5 enables a useful characteristic described below.

The plates 40 are connected to the valve by a linkage mechanism typically in the form of link arms 42. The link arms 42 are typically provided at the upper and lower ends of each plate 40, and are typically pivotally connected to the plate allowing pivotal movement between the link arms 42 and the plate 40. Typically, each plate 40 has four link arms 42, two connected at its lower end, and two connected at its upper end. Typically, one end of each link arm 42 is pivotally connected to the plate, and the other end of each link arm 42 is pivotally connected to either one of an upper and lower sleeve provided at opposite ends of the actuator V. Therefore, at the lower end of the plates 40, each pair of link arms 42 pivotally connects to a fixed sleeve 45. Typically, the fixed sleeve 45 is secured to the inner surface of the central portion of the bore 8, optionally by bolts or pins or other fixings, so that it is axially fixed in position within the bore 6.

Figure 4:
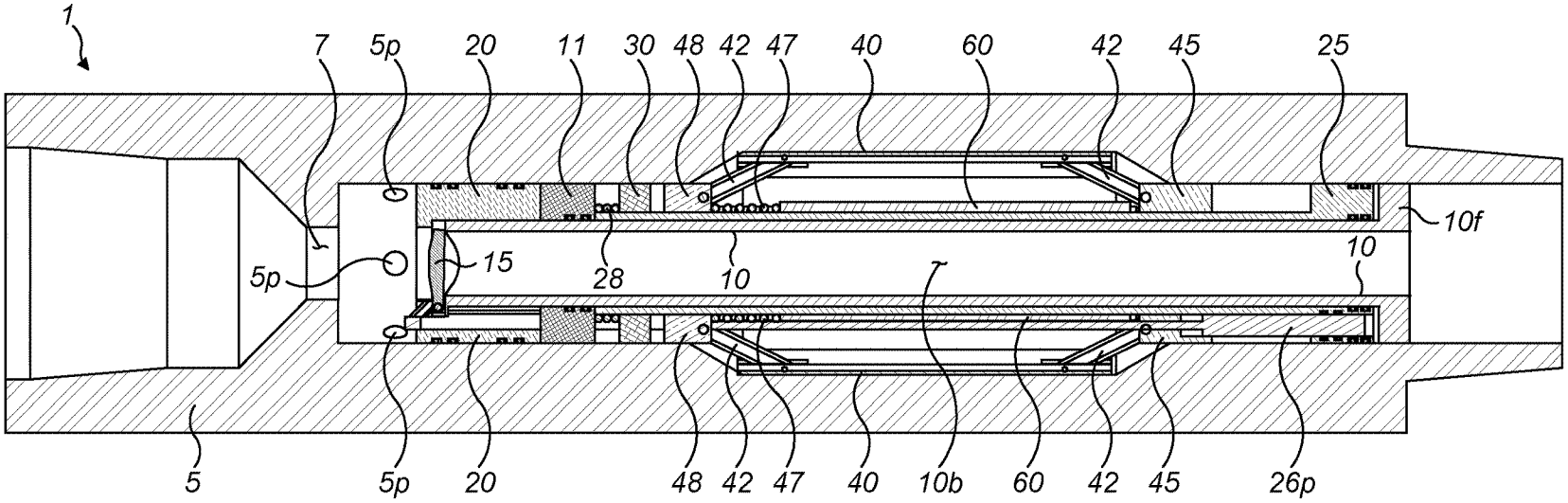
FIG. 4 shows the FIG. 1 device in a circulating position with bore closed and the circulation ports open.
Figure 5:
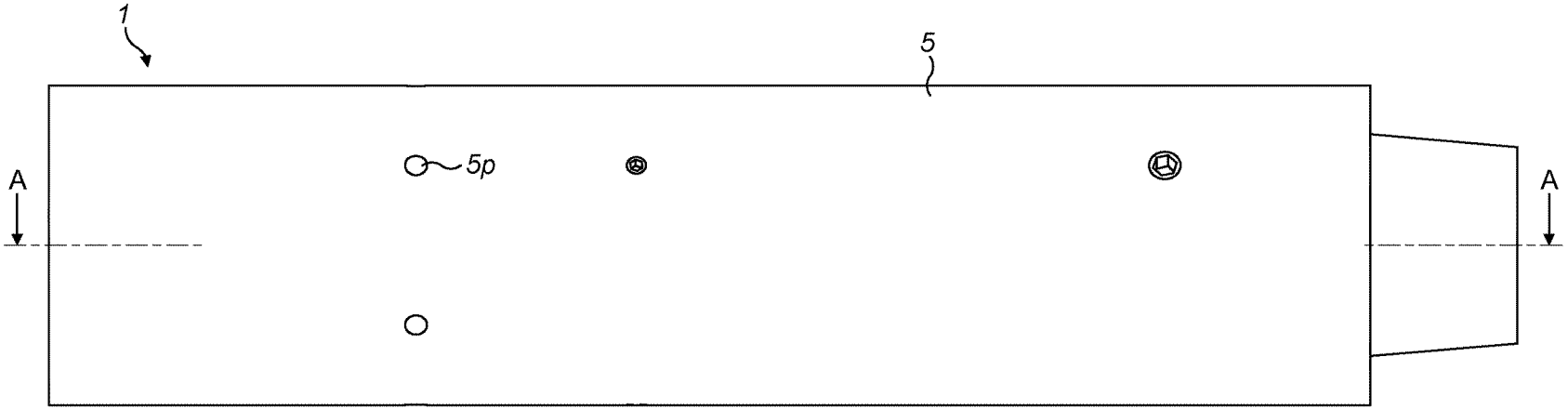
FIG. 5 shows a side view of the FIG. 1 device.

At the upper end of each plate 40, the plate 40 is typically connected by a respective pair of link arms 42 to a sliding sleeve 48 in the same way. The sliding sleeve 42 is free to move axially within the bore 6. Typically, the pivotal connections between the plate 40 and the link arms 42 are axially spaced from the upper and lower ends of the plate 40, as best shown in FIG. 4. Typically the pivotal connections between the plate 40 and the link arms 42 are spaced circumferentially around the plate. Typically the link arms 42 connecting the plates 40 with the collars 45, 48, are adapted to resist rotation of the plates 40. This can typically be achieved by providing at least two link arms 42 at each radially spaced location (respective upper and lower ends) of each plate, and connecting the link arms at circumferentially spaced pivot points between the plate 40 and the link arms 42, thereby resisting rotation of the plate around the long axis, and maintaining stability of the plate 40 as the plate transitions between the first and second configurations.

Therefore, each plate 40 is connected by link arms 42 between a single lower fixed sleeve 45 and a single upper sliding sleeve 48. The link arms 42 guide and restrict the movement of the plates 40 in a radial direction within the annulus 9*a* of the expansion chamber 9. All plates 40 typically move simultaneously as a result of the link arms 42 and the sleeves 45, 48. Therefore, all four plates 40 are constrained to move radially outwardly from the radially retracted position shown in FIG. 2 to the radially extended position shown in FIG. 3 in concert with one another, so that, at any particular point, each plate 40 is the same radial distance away from the outer surface of the tubular 10, and has the same orientation, i.e. parallel to the axis of the tubular 10. Radially outward movement of the plates 40 in this manner therefore draws the sliding sleeve 48 towards the fixed sleeve 45, which cannot move axially within the body 5, so radial extension of the plates causes the sliding sleeve 48 to slide axially within the central section of the bore 8 down towards the fixed sleeve 48. The force generated from the axial rotation can typically vary with the mass of the plates (which can be varied by adjusting their length, number and circumferential dimensions). In the typical example described with four plates the typical force generated is approximately 3.5 kgf (7.7 lbft) at 150 rpm. Other examples can be devised having a larger number of plates 40, with a reduced radial travel, and optionally a larger radial dimension of the initial radially retracted first position. Because of the increased centrifugal force resulting from a greater radius of the rotated mass, this enables an increase in the internal dimensions of the bore 10*b* in the tubular 10, while maintaining a high force from the governor mechanism surrounding the tubular 10, and represents a significant advantage to certain examples of the invention.

Figure 6:
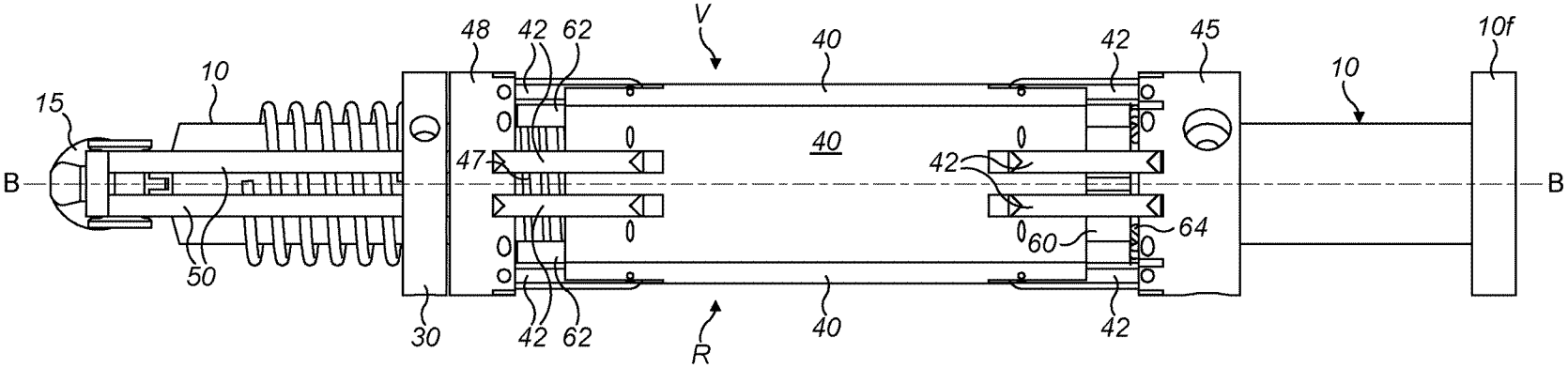
FIG. 6 shows a side view of the counterweight assembly inside the body of the FIG. 1 device in configurations shown in FIG. 1.
Figure 7:
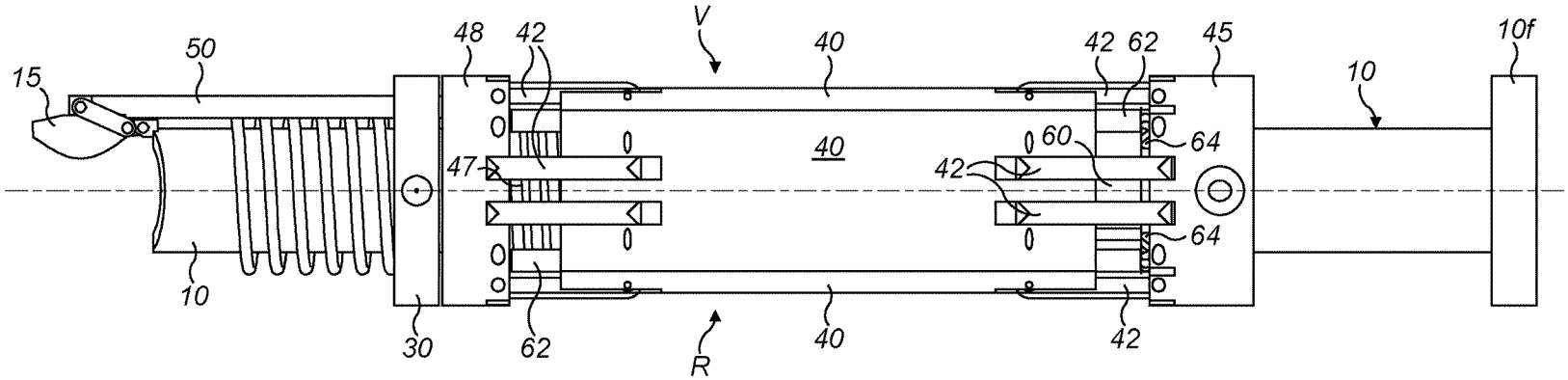
FIG. 7 shows a side view similar to FIG. 6 of the FIG. 1 device, but rotated through 90°.
Figure 8:
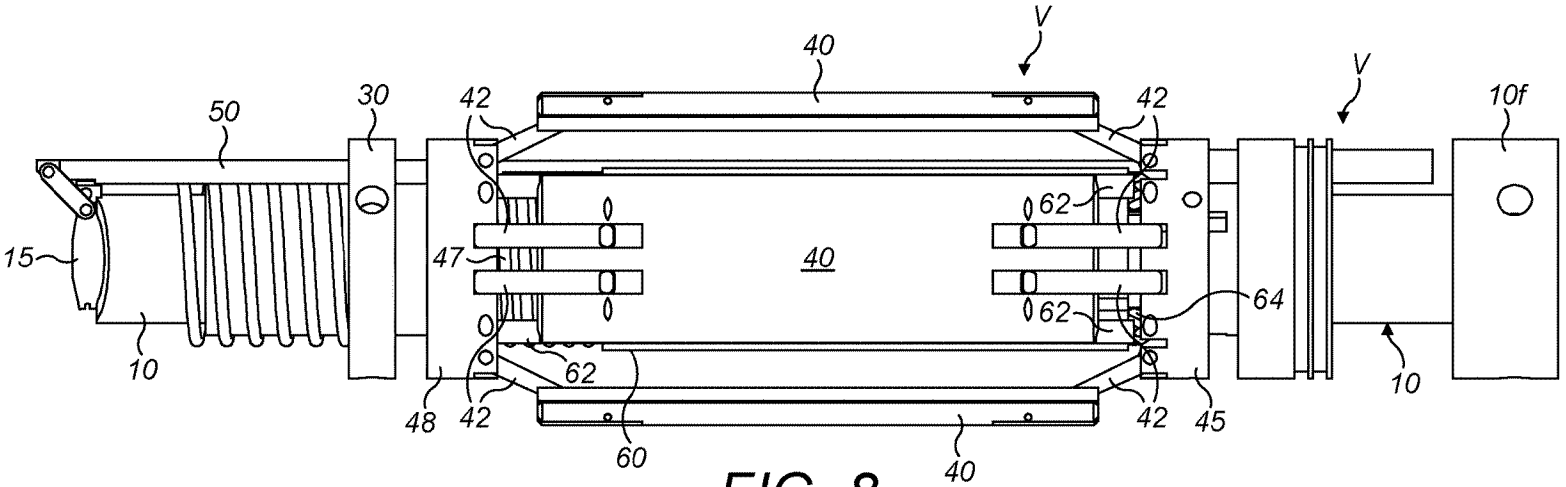
FIG. 8 shows a side view similar to FIG. 7, with the bore of the device closed.
Figure 9:
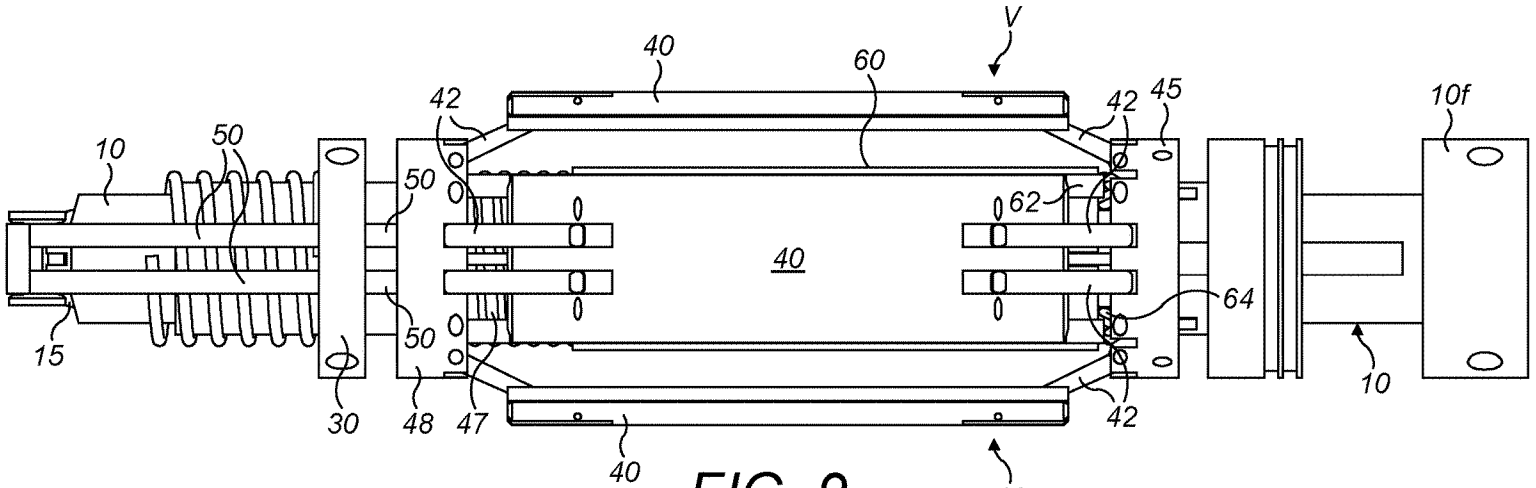
FIG. 9 shows a side view similar to FIG. 6 rotated through 90°, with the bore closed.

As best seen in FIGS. 6 to 9, a control rod 50 connects the sliding sleeve 48 with a pivot mechanism operatively connected to the flapper 15. When the sliding sleeve 48 is in the uppermost position as best shown in FIG. 7, with the plates 40 in their radially retracted position, the control rod 50 typically pushes the flapper up away from the inlet of the tubular 10, to open the bore of the tubular 10. This is the position adopted in FIGS. 6 and 7. When the sliding sleeve 48 moves axially downwards as a result of radial displacement of the plates 40, as best shown in FIGS. 8 and 9, the control rod 50 causes the flapper 15 to move to the closed position where it occludes the opening of the upper end of the tubular 10, preventing or at least reducing fluid flow through the tubular 10. In the present example, the control rod 50 typically comprises a pair of rods or bars extending axially generally parallel to the axis of the tubular 10, along its outer surface, but in other examples, the control rod or other actuator transmitting the motive force or signals from the actuator to the closure device can take other forms.

Typically the control rod 50 moves down to rotate the flapper down to a closed position around a pivot point between the flapper 15 and the upper end of the tubular 10. However, in certain other examples, the flapper 15 and control rod 50 could move in opposite directions, or the flapper 15 could be closed by fluid pressure, and could optionally have a spring mechanism to open it against the force of the fluid pressure.

In use, the circulation sub 1 is run into the hole in the configuration shown in FIG. 1, with the plates 40 in the radially retracted position, close to the axis of the tubular 10. In this configuration, the sliding sleeve 48 is urged upwardly within the bore 6, so the control rod 50 keeps the flapper 15 open as shown in FIGS. 1 and 6. The sliding sleeve 48 adopts an axial position close to the fixed block 30, as best shown in FIGS. 1 and 6. The plates 40 are radially collapsed, close to the axis of the sub 1.

The spring 28 is held in compression between the fixed block 30, and the sliding spacer ring 11, thereby pushing the control piston 20 towards the top of the bore 6, adjacent to the throat 7. In this position, the flapper 15 is urged upwards clear of the recess 21 and is held in the open position by the control rod 50. Fluid can pass through the bore 10*b* in either direction allowing efficient running in. The circulation sub 1 can act as a fluid conduit for supplying drilling fluid or other wellbore fluids to tools situated lower down in the string, beneath the circulation sub 1. Typically, the circulation sub 1 is set relatively high in the string, above the drill bit, and typically above scraping and other cleaning tools, which typically generate particulate debris and cuttings from their drilling, cleaning and scraping operations.

Figure 2:
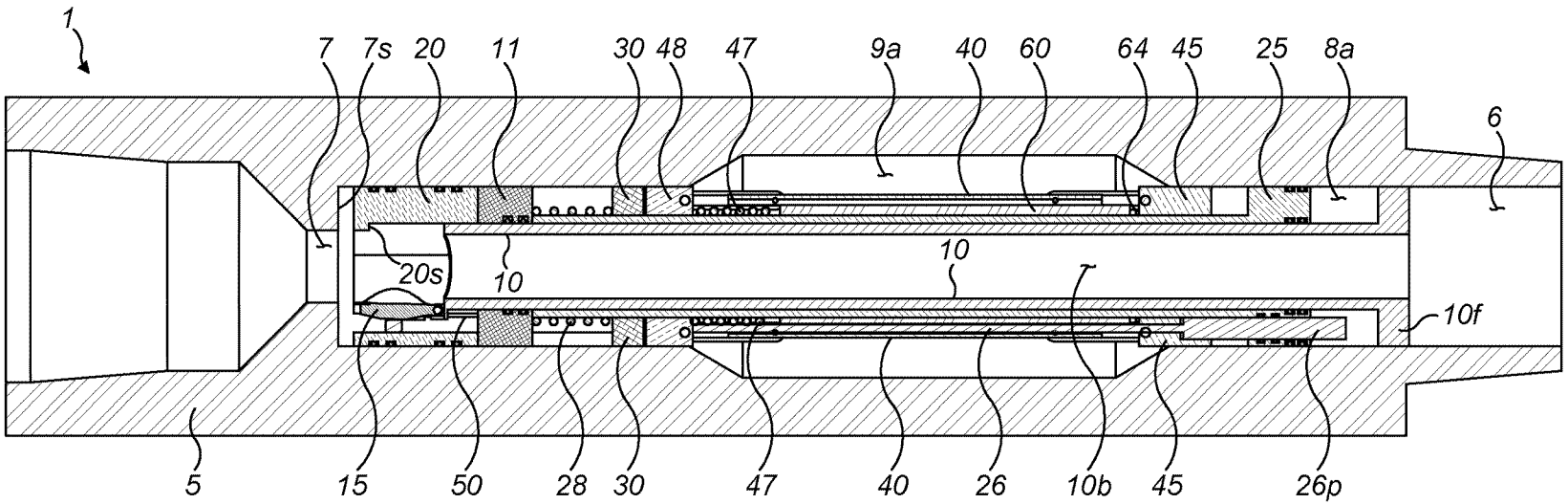
FIG. 2 shows the FIG. 1 device in a locked configuration with fluid flowing through the device.

The fluid conduit position is shown in FIG. 2. In the flowing position shown in FIG. 2, the plates 40 are in the radially retracted position as shown in FIG. 1, the flapper 15 remains open by virtue of the action of the control rod 50. The only difference between FIG. 1 and FIG. 2 configurations is that the control piston 20 has slid axially down the bore, away from the throat, to butt against the sliding spacer ring 11, and to compress the spring 28. The control piston 20 slides as a result of the pressure differential across it within the bore 6. Downward movement of the control piston 20 as shown in the transition from FIG. 1 to FIG. 2 moves the recess 21 over the upper edge of the flapper 15, thereby preventing closure of the flapper 15 across the opening to the tubular 10. The balancing piston 25 typically compensates for any volume changes as a result of the movement of the control piston 20.

In this configuration shown in FIG. 2, the circulation sub 1 behaves as a simple flow conduit allowing passage of fluid from above the circulation sub 1 through the bore 6, in order to reach various tools located below the circulation sub 1 in the string. For example, in drilling operations, drilling fluid can be pumped at high volumes and high speeds through the circulation sub 1 while in the FIG. 2 locked configuration, without radial movement of the plates 40, which remain radially collapsed, and without closure of the locked flapper 15, allowing substantially full bore flow through the large bore tubular 10. Activation of the flapper 15 to close the primary flow path through the bore 10*b* of the tubular 10 is not possible while the control piston 20 is in the FIG. 2 position, so the valve body 5 can be rotated at high speeds, for example when conducting rotary drilling operations, at the same time as pumping drilling fluids through the bore 6 at high pressures, volumes and flow rates, or separately, without activating the valve 1. The control piston 20 is maintained in the locked position axially displaced downwards from the throat 7 as shown in FIG. 2 by the pressure differential applied across the piston 20. While in the locked position, the linkage between the flapper 15 and the sliding sleeve 48 effected by the control rods 50, typically pulls the sliding sleeve 48 upwards in the central portion of the bore 8, thereby keeping the plates 40 in their radially retracted linear position shown in FIGS. 1 and 2, so even with high speed rotation of the drill string and the body 5, the plates 40 remain radially close to the axis of the body 5, and the tool remains in the FIG. 2 retracted configuration.

The downward sliding of the control piston 20 pushes the sliding spacer ring 11 downwards through the central portion 8 of the bore 6, to compress the spring 28 against the fixed spacer 30. This also pushes the optional balancing piston 25 down the bore, as it is secured to the sliding spacer ring 11.

Figure 3:
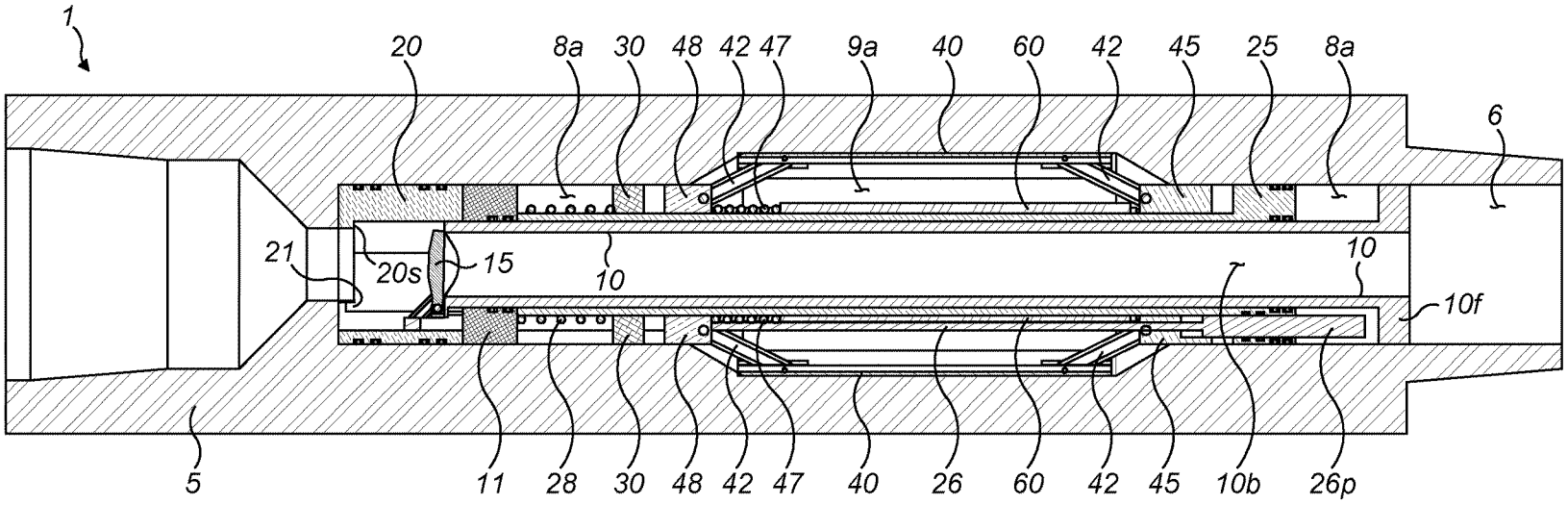
FIG. 3 shows the FIG. 1 device in an unlocked configuration with the bore closed.

When the circulation sub 1 is to be activated, the pressure across the control piston 20 is reduced until the force of the spring 28 overcomes the force on the piston 20 exerted by the pressure differential, and the spring 28 then returns the piston 20 to the upper position shown in FIG. 3, butted against the downwardly facing shoulder 7*s* of the central portion of the bore 8, adjacent to the throat 7. In this configuration, the flapper 15 is free from the recess 21 in the control piston 20, as best shown in FIG. 1, and is free to move. The fixed and sliding sleeves 45 and 48 are biased apart by a counterweight spring 47, which is held in compression between the fixed and sliding sleeves 45, 48, and which maintains the counterweight assembly V in the linear retracted configuration shown in FIGS. 6 and 7 in the absence of any other force. However, when the circulation sub 1 is to be activated in order to divert fluids passing through the bore 6 to tools situated below the circulation sub 1, and instead pump that fluid out through the wall of the body 5 in order to maintain circulation of particulates within the annulus outside the body 5, the body 5 is rotated from the surface, typically at normal drilling speeds of around 100-150 rpm, and the centrifugal force acting on the plates 40 as a result of the rotation causes them to move radially outwards into the annulus 9*a* of the expansion chamber 9. Because the control piston 20 has moved up, and the flapper 15 is clear of the recess 21, the plates 40 are free to move radially outwards within the annulus 9*a*, against the force of the spring 47, which is compressed further between the fixed and sliding sleeves 45, 48, which move axially together as best shown in the transition between the FIGS. 2 and 3. The radial outward movement of the plates 40 effectively pulls the sliding sleeve 48 axially down the bore 6, towards the fixed sleeve 45, which is fixed immovably to the body 5, as a result of the link arms 42. As the sliding sleeve 48 is operatively linked to the flapper 15 by virtue of the control rod 50, the radial outward movement of the plates 40 under the centrifugal force resulting from the rotation therefore pulls the control rod 50 axially down the bore 6 in order to close the flapper 15 over the inlet at the upper end of the tubular 10, thereby closing the bore 6 through the body 5 as best shown in FIG. 3. The flapper 15 is thereby locked in the closed position by the sleeve above it. The closed flapper position also helps to maintain the radially outward configuration of the plates 40. The inner counterweight assembly V inside the body 5 is then in the configuration shown in FIGS. 8 and 9.

With the circulation sub 1 still rotating, the fluid pressure above the closed flapper 15 then increases, causing the control piston 20 to move down the central portion of the bore 8 from the position shown in FIG. 3 to the position shown in FIG. 4. Typically the control piston 20 has seals above and below circulation ports 5*p* in the body 5, so that in the running in configuration shown in FIG. 1, the circulation ports 5*p* are sealed off (typically by double seals) from the bore 6 of the circulation sub 1. The downward movement of the piston 20 exposes circulation ports 5*p* passing through the wall of the body 5 and connecting the bore 6 with the annulus outside the body 5, and allowing the high pressure fluid to be jetted radially out through the ports 5*p* when the counterweight assembly V is in the configuration shown in FIG. 4. In that configuration, the shoulder 20*s* on the downward facing surface of the control piston 20 presses downwards on the top of the flapper 15, keeping it sealed over the inlet to the bore 10*b* of the tubular 10, and thereby preventing fluid flow through the bore 10*b* of the tubular 10, so that substantially all of the fluid passing through the throat 7 is diverted through the circulation ports 5*p*, and is available to jet radially outwards into the annulus, and wash particulates and other debris in the annulus towards the surface. Keeping the flapper 15 pressed down against the inlet at the upper end of the tubular 10 also keeps the sliding sleeve 48 urged axially downwards towards the fixed sleeve 45, thereby keeping the plates 40 in their radially expanded configuration shown in FIG. 4, even in the absence of sufficient rotation to generate the central centrifugal force to overcome the force of the spring 47. Typically the flapper 15 has a bypass port (not shown) to allow partial flow through the bore 6 in order to provide some reduced flow to tools below the circulation sub if required. This is an optional feature and is not required in all examples. The balance piston 25 typically compensates for the volume changes in the system arising from the movement of the components in this phase.

Once the flapper 15 is closed and the plates 40 have swung out to the radially extended position within the chamber 9, the fluid pressure acting on the piston 20 is generally sufficient to keep the control piston 20 pressed down against the top of the flapper 15, keeping the flapper 15 closed and retaining the seal on the tubular 10, and maintaining the circulating position, even in the absence of rotation. Therefore, when circulating with the control piston 20 in its axially downward position exposing the circulation ports, rotation is not necessary, but can be conducted without affecting the circulation operations.

When the circulation operation is completed, and the circulation ports 5*p* are to be closed, the pressure on the piston 20 (typically from surface pumps) is reduced until the force of the spring 28 returns the sliding spacer ring 11 and piston 20 to the FIG. 1 position. In this configuration, the flapper 15 can still remain closed, with the plates 40 and the radially extended configuration shown in FIG. 4 if the body 5 is still subject to sufficient rotation to generate the required centrifugal force to maintain the plates 40 in their radially extended configuration. Therefore, operation of the flapper 15 can optionally be independent of the movement of the control piston 20. However, in most situations, the rotation of the body 5 at this point will be reduced to reduce the centrifugal force acting on the plates 40, and allow the spring 47 to urge the sliding sleeve 48 axially back up the central portion of the bore 8, and open the flapper 15, so that the configuration of the circulation sub returns to the FIG. 1 and FIG. 2 positions, again allowing fluid flow at high velocity and high pressure through the bore 6 across substantially the full bore of the tubular 10.

In certain examples, one optional feature relates to the balancing piston 25. Examples can be constructed without this component, but in the current example it performs a useful optional function, in that it permits equalisation of the volume of the expansion chamber 9 in the different modes of operation of the device. The balancing piston 25 is sealed within the annulus 8*a* at the lower end of the central portion of the bore 8. Typically the chamber 9 is filled with hydraulic fluid, and is typically sealed. The radially outwards movement of the plates 40 and the downward sliding movement of the sliding sleeve 48 when the circulating sub transitions between the FIG. 2 and FIG. 3 positions can typically cause small volume changes in the chamber 9. These can sometimes result in changes in hydraulic pressure of the fluid within the sealed chamber 9, leading to hydraulic lock. These volume changes can optionally be accommodated by sliding of the balancing piston 25 in order to maintain the volume (and therefore the pressure) of the fluid within the chamber 9 within relatively constant ranges. The balancing piston 25 is connected at its upper end to the sliding spacer ring 11, and is generally biased upwardly within the annulus 80 by the spring 28 acting in compression between the fixed spacer 30 and the sliding spacer ring 11. Volumetric changes in the chamber 9 caused by transition of the plates 40 and downward sliding of the sliding sleeve 48 typically cause pressure changes within the hydraulic fluid in the chamber 9 which act on the sealed piston area of the balancing piston 25. Typically the force of the spring 28 is such that the balancing piston 25 can typically cause it to compress slightly to pull the sliding spacer ring 11 axially down the body 5 in order to accommodate the slightly larger volume and increased pressure and balance out any hydraulic locks. The balancing piston 25 therefore accommodates changes in volume and pressure of the hydraulic fluid within the chamber 9, and combats the sticking of the sliding sleeve 48 as a result of hydraulic lock. The details of the seals of the balancing piston 25 are best shown in FIG. 10.

Figure 10:
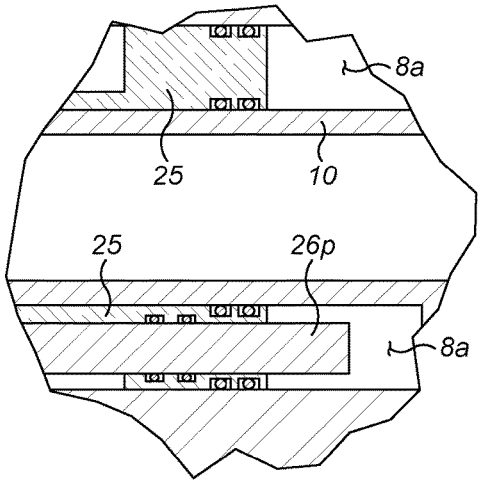
FIG. 10 shows an enlarged view of the lower end of FIG. 2, illustrating the detail of a balancing mechanism of the device.

Optionally, the balancing piston 25 has a balance rod mechanism comprising a balance rod extending axially on one side of the bore, and terminating in a piston head 26*p* which is sealed within the enlarged lower flange of the balance piston 25 (the details of which are best shown in FIG. 10). The upper end of the balance rod 26 is connected to the sliding sleeve 48, so that downward movement of the sliding sleeve 48 in response to outward movement of the plates 40 in the chamber 9 causes concurrent downward movement of the piston head 26*p* sealed within the flange of the balance piston 25. The linear movement of the balance rod 26 with the upper sliding sleeve 48 compensates for differences in volume as the sleeve moves and resists hydraulic locking.

Figure 11:
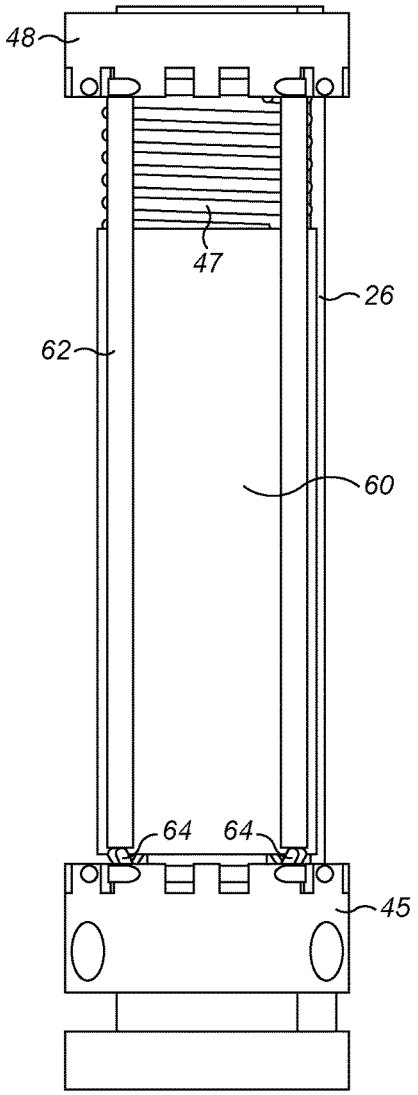
FIGS. 11, 12 and 13 indicate side and cutaway views of an optional compensation mechanism of the FIG. 1 device.
Figure 12:
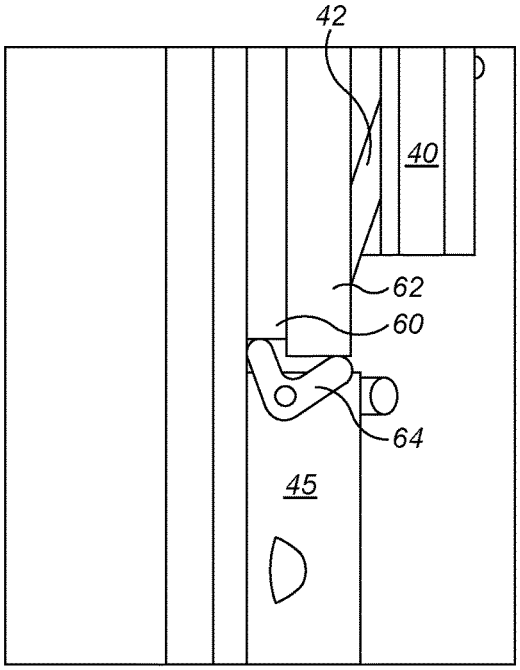
Figure 13:
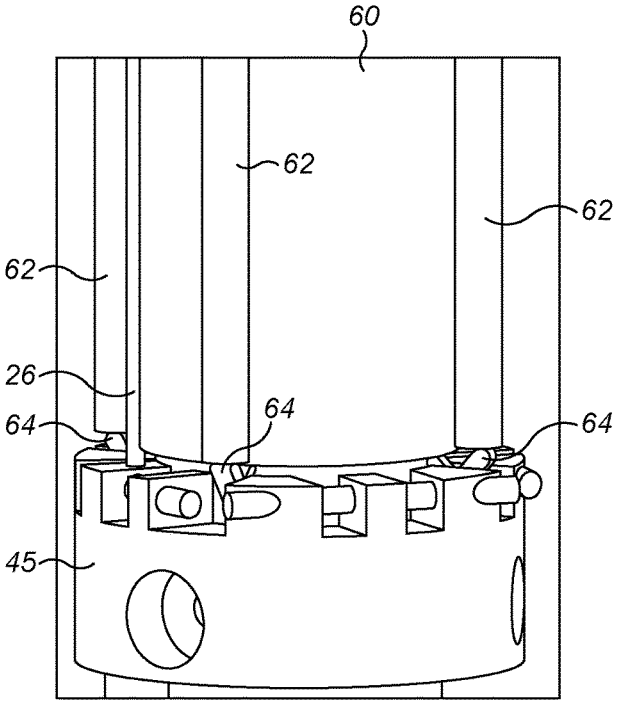

A further optional feature that is useful in certain examples of the invention but is not required in others is an orientation compensating mechanism, shown in FIGS. 11, 12 and 13.

Optionally, the compensating mechanism typically comprises a floating sleeve 60 freely movable around the outer surface of the spring 47. The sleeve 60 is typically supported from beneath by cam devices 64 spaced equidistantly around the circumference of the sleeve, which are supported in pivot mountings on the upper surface of the fixed sleeve 45, so that one inner end of the cam device 64 supports the lower surface of the sleeve 60. An outer end of the cam device 64 typically supports a push rod 62 which extends between the cam device 64 and the opposing lower surface of the sliding sleeve 48. When the body 5 is in a vertical orientation, as shown schematically in FIG. 11, the sleeve 60 slides down under gravity to bear on the upper surface of the inner part of the cam device 64, so that the weight of the sleeve 60 is borne by the cam devices 64, which rotate about their pivot mountings in the fixed sleeve 45, and push the outer ends of the cam devices 64 upwards, thereby urging the push rods 62 axially upwards, to push the sliding sleeve 48 axially away from the fixed sleeve 45. This balancing action only takes effect when the body 5 is in the vertical position as shown in FIG. 11, and the sleeve 60 is pulled under gravity to rest on the cam member 64, and when the body 5 is in the horizontal position, the sleeve 60 is free to slide axially between the fixed and sliding sleeves 45, 48, and does not apply the same force to the cam devices 64, which in turn, do not exert the same axial force on the push rods 62. Therefore, the balancing mechanism shown in FIGS. 11 to 13 typically provides additional axial force acting to spread the sleeves 45, 48 apart from one another when the body 5 is in the vertical orientation. This is a useful feature which compensates for the weight of the plates 40, which tend, in the vertical position, to fall radially outwards due to gravitational force. The plates 40 are maintained in their axially retracted position shown in FIG. 1 by the spring 47, but the balancing action of the compensation mechanism shown in FIGS. 11 to 13 means that when the body 5 is in the vertical orientation as shown in FIG. 11, the weight of the sleeve 60 counteracts the tendency of the plates 40 to fall outwards, and the force applied by the spring 47 can therefore be reduced. Since the compensating mechanism shown in FIGS. 11 to 13 only applies any force to the governor mechanism when the body 5 is in the vertical position, it selectively compensates the activation force between the horizontal and the vertical positions, leading to a more consistent operation of examples of the invention that utilise this feature.

Examples of the invention can, of course, be constructed without necessarily requiring the compensation mechanism shown in FIGS. 11 to 13, but it has the advantage that the spring 47 can be reduced in strength, and the tool can be operated in a wider variety of operational situations.

Examples of the invention provide advantages over earlier systems, in that as the arrangement of counterweight devices is typically balanced around the axis of the body, rotation of the counterweight devices to move them between the first and second configurations is substantially unaffected by the orientation of the axis within the bore hole, enabling the actuator to be used in deviated wells with greater consistency of operation. Examples of the invention therefore facilitate operations at various different angles of deviated well in a consistent manner.

Examples of the invention typically permit easier activation at normal drill string speeds, for example actuation of the circulation sub described in the examples herein can be achieved at drill string rotation speeds of around 100 to 150 rpm, and in certain examples, the actuator can be maintained in the circulating position by continued flow, with or without continued rotation at the transition speed. The transition speed can typically be adjusted by adjusting the spring strengths and the weights of the plates to suit particular wellbore conditions and different string diameters. Certain examples can easily be reset to the original configuration by stopping flow through the valve with no rotation, or with rotation at speeds below the transition level. Again, this can be adjusted independently by selecting different spring tensions allowing additional adaptability of the device.

The circulation sub 1 can typically be locked in normal and circulating positions and reset any number of times to original configurations without reliance on dropped balls or other actuation mechanisms requiring reset or recovery of the string.

In certain examples of the invention, the plates 40 do not require symmetrical movement, and in one simplified example of the invention, the plates are directly linked at pivot points to the fixed collar 45, and are linked by link arms 42 to the sliding collar 48, so that only one end of the plates 40 (e.g. the upper end) moves radially outwards into the expansion chamber. However, the example shown in the figures with link arms at each end of the plates is advantageous, as it allows a longer travel of the sliding collar 48.

Typically the tubular 10 is fixed within the bore 6. Optionally, the tubular 10 can have a ball seat (not shown) for emergency operation in the event that the flapper 15 becomes stuck, allowing a ball to be dropped into the ball seat (not shown) to close the bore 10*b* of the tubular 10, allowing pressure to build up above the tool to move the control piston 20 down and expose the circulation ports 5*p* as described above.

Examples of the invention permit increased bore diameter in circulating subs allowing operation of conventional tools through the bore, while at the same time permitting a decreased outer diameter and typically decreased total length. An increased centrifugal force is permitted at lower rotational speeds, and the balanced governor mechanism increases the stability of the tool and allows simplification of the design.

The invention claimed is:

1. A method of actuating a downhole device in a tubing string in an oil or gas well, the tubing string having a tubing string axis, the downhole device having a body with a body axis co-axial with the tubing string axis, a flowpath allowing axial passage of fluid through the body, and a closure device adapted to restrict passage of fluid through the flowpath, and having first and second counterweight devices connected on either side of the body axis, the method comprising:

rotating the device around the body axis, causing radial movement of the counterweight devices away from the body axis from a first position to a second position wherein the counterweight devices are spaced radially further from the body axis in the second position than in the first position, whereby movement of the counterweight devices away from the body axis from the first position to the second position at least partially closes the closure device and restricts the flowpath through the tubing string; and inter-connecting the counterweight devices with upper and lower sleeves at axially spaced apart locations on the counterweight devices.

2. A method as claimed in claim 1, including maintaining a parallel orientation of the counterweight devices relative to the body axis as the counterweight devices move between the first and second positions.

3. A method as claimed in claim 1, including controlling the extent and path of radial movement of the counterweight devices between the first and second positions.

4. A method as claimed in claim 1, including balancing the volume of hydraulic fluid within the body of the device between the first and second positions of the counterweight devices.

5. A method as claimed in claim 1, wherein the device comprises a valve and wherein the flowpath has an inlet, a primary outlet and a secondary outlet, and wherein the method includes diverting at least some of the fluid passing through the flowpath to the secondary outlet rather than to the primary outlet by closing the closure device.

6. A method as claimed in claim 1, including locking the counterweight devices in a radially collapsed configuration while opening the closure device to permit flow of fluid through the flowpath.

7. A method as claimed in claim 1, including locking the closure device in a closed configuration and urging the counterweight devices into a radially expanded configuration by a link rod operatively connected to transfer forces between the closure device and the counterweight devices.

8. A method as claimed in claim 1, including operatively connecting the counterweight devices to the closure device, and transmitting an activation state of one of them to the other.

9. A method as claimed in claim 1, including diverting at least some of the fluid passing through the flowpath into a circulation pathway which passes through the body of the downhole device to circulate the fluid outside the tubing string when the closure device is in a closed position, and allowing passage of at least some of the fluid through a port in the closure device when the closure device is in a closed position.

10. A method of actuating a downhole device in a tubing string in an oil or gas well, the tubing string having a tubing string axis, the downhole device having a body with a body axis co-axial with the tubing string axis, a flowpath allowing axial passage of fluid through the body, and a closure device adapted to restrict passage of fluid through the flowpath, and having first and second counterweight devices connected on either side of the body axis, the method comprising:

rotating the whole tubing string around the tubing string axis during rotary wellbore operations and driving the counterweight devices in a radial direction with respect to the body axis by centrifugal force created by the rotation of the tubing string;

wherein the counterweight devices move radially outwards from the body axis between first and second positions and the counterweight devices are spaced radially further from the body axis in the second position than in the first position; and wherein radial movement of the counterweight devices away from the body axis from the first position to the second position at least partially closes the closure device and restricts the flowpath through the tubing string.

11. A method as claimed in claim 10, including balancing a volume and/or pressure changes of hydraulic fluid within the body of the device between the first and second positions of the counterweight devices.

12. A method as claimed in claim 10, including interconnecting the counterweight devices with upper and lower sleeves at axially spaced apart locations on the counterweight devices.

13. A method as claimed in claim 12, including spacing the counterweight devices circumferentially and equi-distantly around the upper and lower sleeves.

14. A method as claimed in claim 12, including connecting the upper and lower sleeves to the counterweight devices by link arms pivotally connected between the sleeves and the counterweight devices at upper and lower ends of the counterweight devices; wherein the link arms restrict and control the extent and path of radial movement of the counterweight devices between the first and second positions.

15. A method as claimed in claim 14, including transmitting axial forces via the link arms between the upper and lower sleeves at the axially spaced positions of the counterweight devices and thereby controlling relative axial movement between the upper and lower sleeves when the counterweight devices move radially.

16. A method as claimed in claim 15, including triggering an actuator by radially moving the counterweight devices and axially moving the upper and lower sleeves, wherein the actuator activates the closure device by changing the configuration of a linkage mechanism that is operatively connected between one of the upper and lower sleeves and the closure device.

17. A method as claimed in claim 10, including locking the closure device in one of an open configuration and a closed configuration.

18. A method as claimed in claim 10, including maintaining a parallel orientation of the counterweight devices relative to the body axis as the counterweight devices move between the first and second positions.

19. A method as claimed in claim 10, including controlling the extent and path of radial movement of the counterweight devices between the first and second positions.

20. A method as claimed in claim 10, including balancing the volume of hydraulic fluid within the body of the device between the first and second positions of the counterweight devices.

21. A method as claimed in claim 10, wherein the device comprises a valve and wherein the flowpath has an inlet, a primary outlet and a secondary outlet, and wherein the method includes diverting at least some of the fluid passing through the flowpath to the secondary outlet rather than to the primary outlet by closing the closure device.

* * * * *